US011692401B2

(12) United States Patent
Yi et al.

(10) Patent No.: US 11,692,401 B2
(45) Date of Patent: Jul. 4, 2023

(54) MULTI-IMPELLER PASSIVE-ROTATING-STIRRING-TYPE ROTARY DRILLING RIG FOR OPEN CAISSONS

(71) Applicant: Zhejiang University, Zhejiang (CN)

(72) Inventors: Guodong Yi, Zhejiang (CN); Shaoju Zhang, Zhejiang (CN); Zhenan Jin, Zhejiang (CN); Shuyou Zhang, Zhejiang (CN)

(73) Assignee: Zhejiang University, Zhejiang (CN)

( * ) Notice: Subject to any disclaimer, the term of this patent is extended or adjusted under 35 U.S.C. 154(b) by 372 days.

(21) Appl. No.: 17/042,925

(22) PCT Filed: Dec. 31, 2019

(86) PCT No.: PCT/CN2019/130324
§ 371 (c)(1),
(2) Date: Sep. 29, 2020

(87) PCT Pub. No.: WO2020/238206
PCT Pub. Date: Dec. 3, 2020

(65) Prior Publication Data

US 2022/0333444 A1 Oct. 20, 2022

(30) Foreign Application Priority Data

May 24, 2019 (CN) ..... 201910438767.5

(51) Int. Cl.
*E21B 10/43* (2006.01)
*E21B 12/00* (2006.01)
*E21B 21/00* (2006.01)

(52) U.S. Cl.
CPC ..... *E21B 10/43* (2013.01); *E21B 12/00* (2013.01); *E21B 21/00* (2013.01)

(58) Field of Classification Search
CPC ..... E21B 10/43; E21B 12/00; E21B 21/00; E21B 10/42
See application file for complete search history.

(56) References Cited

FOREIGN PATENT DOCUMENTS

CN 101245596 A * 8/2008
CN 109681116 A * 4/2019 ..... E21B 10/26

* cited by examiner

*Primary Examiner* — Caroline N Butcher

(57) ABSTRACT

A multi-impeller passive-rotating-stirring-type rotary drilling rig for open caissons includes a hollow main drill pipe, a drill bit, four cutting edges, four impeller shafts, four passive impellers and a rotation bracket. Through being uniformly distributed at a peripheral of the drilling rig, four passive impellers contact with a hole wall of a borehole during the drilling process for passively generating relative rotation opposite to the rotation direction of the drill bit, so as to accelerate sufficient mixing of silt and water for forming mud during the drilling process.

6 Claims, 2 Drawing Sheets

MULTI-IMPELLER PASSIVE-ROTATING-STIRRING-TYPE ROTARY DRILLING RIG FOR OPEN CAISSONS

CROSS REFERENCE OF RELATED APPLICATION

This is a U.S. National Stage under 35 U.S.C 371 of the International Application PCT/CN2019/130324, filed Dec. 31, 2019, which claims priority under 35 U.S.C. 119(a-d) to CN 201910438767.5, filed May 24, 2019.

BACKGROUND OF THE PRESENT INVENTION

Field of Invention

The present invention is mainly applied to the large-scale hydraulic reverse circulation drilling rig in the construction field of caisson of intermediate tower of the bridge, and more particularly to a multi-impeller passive-rotating-stirring-type rotary drilling rig for open caissons.

Description of Related Arts

A construction method of a reverse circulation drilling rig comprises steps of injecting original slurry into a borehole through a drill pipe, and sucking mud mixed with silt out of the drill pipe by a vacuum pump or other methods (such as an air-power silt collector) thus achieving the purpose of discharging the mud.

During the construction process of caisson of intermediate tower of the bridge, the common soft soils are mainly silt and silty clay whose main properties are large thickness, high void ratio, high compressibility and high sensitivity, which contains more powder, has thixotropy, and has poor engineering properties. Existing hydraulic drilling rigs for drilling and pouring construction of caisson of intermediate tower of the bridge have poor mixing effect on silt and water, low mud absorption efficiency and difficulty in draining mud, resulting in low drilling efficiency, blockage and silting of mud suction pipes, siltation and even breakage of drill bits.

SUMMARY OF THE PRESENT INVENTION

In order to solve problems in the background art, the present invention provides a multi-impeller passive-rotating-stirring-type rotary drilling rig for open caissons, which is mainly configured to drilling and pouring construction of caisson of intermediate tower of a bridge by a reverse circulation drilling machine.

According to the present invention, during a drilling process, a rotation bracket rotates synchronously with a drill bit and a hollow drill pipe for driving four impeller shafts to rotate synchronously around a central axis of the drill bit. During the rotation of the impeller shafts, four passive impellers are in contact with a hole wall of a borehole, and under double effects of the rotation of the rotation bracket and the static hole wall, the passive impellers rotate around respective impeller shafts thereof opposite to a rotation direction of the drill bit. The relative rotation between the cutting edges and the passive impellers is used to enhance the stirring effect of the silt in the borehole during the drilling process, so that the silt produced by drilling and water are more fully mixed to form the mud. And then the mud is discharged through a mud suction port and the negative pressure in the hollow drill pipe.

The present invention adopts a technical solution as follows.

A multi-impeller passive-rotating-stirring-type rotary drilling rig for open caissons provided by the present invention comprises a hollow main drill pipe, a drill bit, four cutting edges, four impeller shafts, four passive impellers and a rotation bracket, wherein the rotation bracket comprises a central disk, four short beams and four peripheral disks, wherein the four short beams are uniformly distributed along a circumferential direction at an outer side of the central disk, one end of each of the four short beams is connected with one of the four peripheral disks; the hollow main drill pipe passes through the central disk and is fixedly connected with the rotation bracket through the central disk; a mud suction port, which penetrates through the hollow main drill pipe along a radial direction of the hollow main drill pipe, is provided at a bottom portion of the hollow main drill pipe; the drill bit is coaxially fixed with the hollow main drill pipe at a bottom end thereof; the four cutting edges are uniformly distributed along a circumferential direction of the drill bit; multiple cutter teeth are uniformly distributed along an outer side of a cutting direction of each of the four cutting edges.

Preferably, a first sealed end cover is installed at a lower surface of each of the four peripheral disks, a second sealed end cover is installed at an upper surface of each of the four cutting edges, a first bearing is installed between the first sealed end cover and the each of the four peripheral disks, a second bearing is installed between the second sealed end cover and the each of the four cutting edges, the first bearing and the second bearing are configured to bear an axial load of each of the impeller shafts, the four peripheral disks are connected with the four cutting edges through the four impeller shafts respectively, an upper end and a lower end of each of the impeller shafts respectively penetrate through the first sealed end cover and the second sealed end cover, and then are respectively connected with the each of the peripheral disks and the each of the four cutting edges through the first bearing and the second bearing, each of the passive impellers, which is fixedly connected with a middle portion of the each of the impeller shafts, comprises six blades centered on the each of the impeller shafts and uniformly distributed along a circumferential direction of the each of the impeller shafts, wherein an angle between two adjacent blades is 60°.

Preferably, during a drilling process, the cutting edges and the rotation bracket are driven to move axially by the hollow main drill pipe while rotating around a central axis of the hollow main drill pipe, so as to drive the impeller shafts to rotate around the central axis of the hollow main drill pipe; the blades of the passive impellers contact with a hole wall of a borehole during a rotation of the rotation bracket, the hole wall provides the passive impellers with a force opposite to a rotation direction of the rotation bracket, so that the passive impellers produce a relative rotation opposite to the rotation direction of the rotation bracket.

Preferably, the first and second sealed end covers are configured to limit a radial displacement of the each of the impeller shafts and have a sealing effect.

Preferably, the hollow main drill pipe is a hollow drill pipe, which is used to discharge mud formed by mixing water and silt produced during the drilling process of caisson of intermediate tower of the bridge.

Preferably, the mud suction port is elliptical, the mud suction port and the passive impellers are located at a same horizontal height.

Preferably, during a rotation of the passive impellers, a working range of an end of the blades of the passive impellers slightly exceeds a maximum working range of the cutting edges, so as to ensure that the passive impellers generate passive rotation.

Beneficial effects of the present invention are as follows.

The present invention is able to enhance the stirring effect of the silt and water in the borehole during the drilling process through the relative rotation of the passive impellers and the cutting edges in opposite directions without adding additional power, so that the mixing and formation of mud are accelerated for further improving the discharge efficiency of the mud produced during the drilling process, thereby improve the efficiency and safety of drilling.

Figure 1:
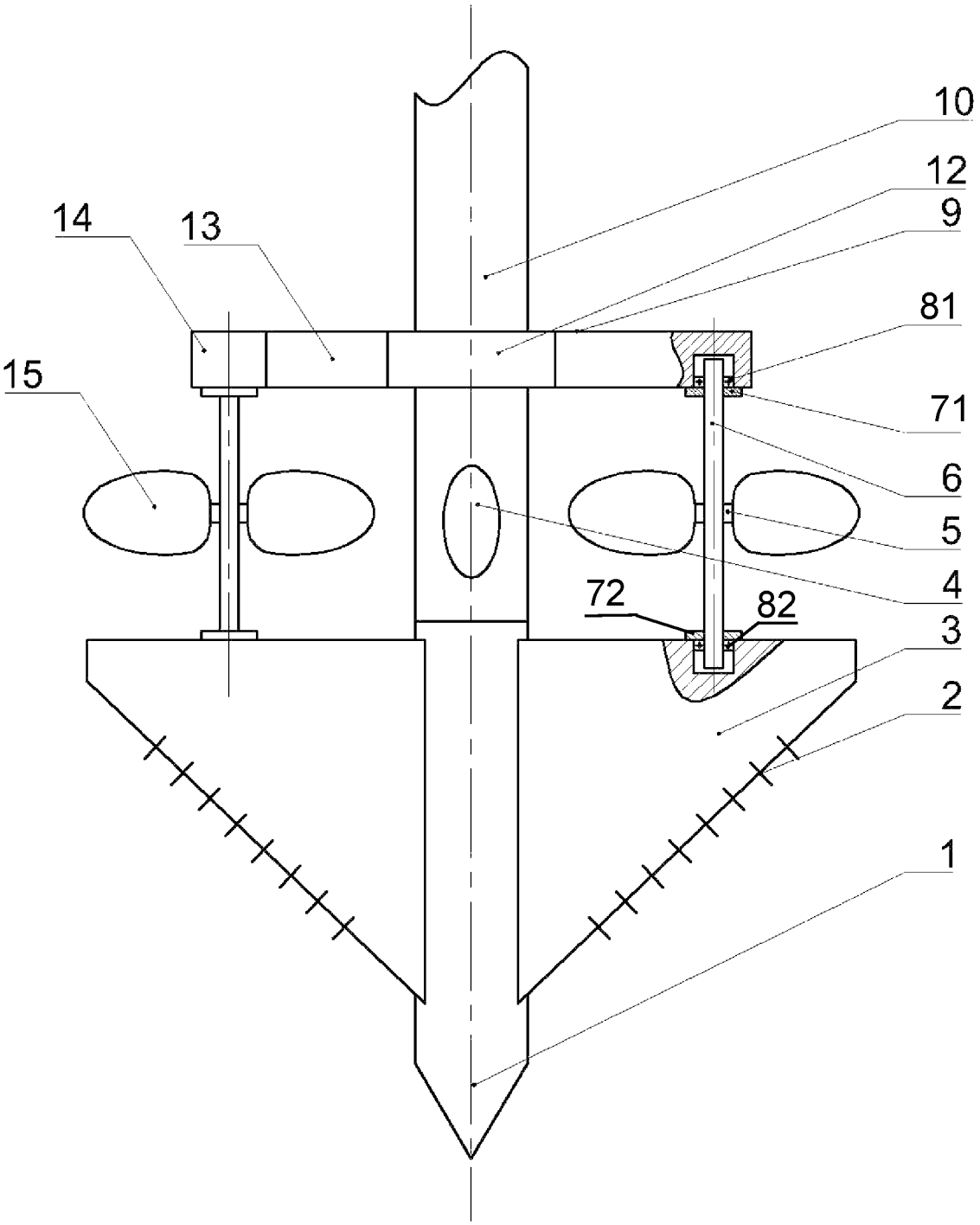
FIG. 1 is a front view of the present invention.

In the drawings, 1: drill bit; 2: cutter tooth; 3: cutting edge; 4: mud suction port; 5: passive impeller; 6: impeller shaft; 71: first sealed end cover; 72: second sealed end cover; 81: first bearing; 82: second bearing; 9: rotation bracket; 10: hollow main drill pipe; 11: hole wall of borehole; 12: central disk; 13: short beam; 14: peripheral disk; 15: blade.

DETAILED DESCRIPTION OF THE PREFERRED EMBODIMENT

The present invention is further described with reference to drawings and embodiments as follows.

Referring to FIG. 1, a multi-impeller passive-rotating-stirring-type rotary drilling rig for open caissons provided by the present invention is illustrated, which comprises a hollow main drill pipe 10, a drill bit 1, four cutting edges 3, four impeller shafts 6, four passive impellers 5 and a rotation bracket 9, wherein the rotation bracket 9 comprises a central disk 12, four short beams 13 and four peripheral disks 14, wherein the four short beams 13 are uniformly distributed along a circumferential direction at an outer side of the central disk 12, one end of each of the four short beams 13 is connected with one of the four peripheral disks 14; the hollow main drill pipe 10 passes through the central disk 12 and is fixedly connected with the rotation bracket 9 through the central disk 12; a mud suction port 4, which penetrates through a front end and a rear end of the hollow main drill pipe 10 is provided at a bottom portion of the hollow main drill pipe 10, that is, the mud suction port 4 penetrates through the hollow main drill pipe 10 along a radial direction thereof; the drill bit 1 is coaxially fixed with the hollow main drill pipe 10 at a bottom end thereof; the four cutting edges 3 are uniformly distributed along a circumferential direction of the drill bit 1; multiple cutter teeth 2 are uniformly distributed along an outer side of a cutting direction of each of the four cutting edges 3.

Figure 2:
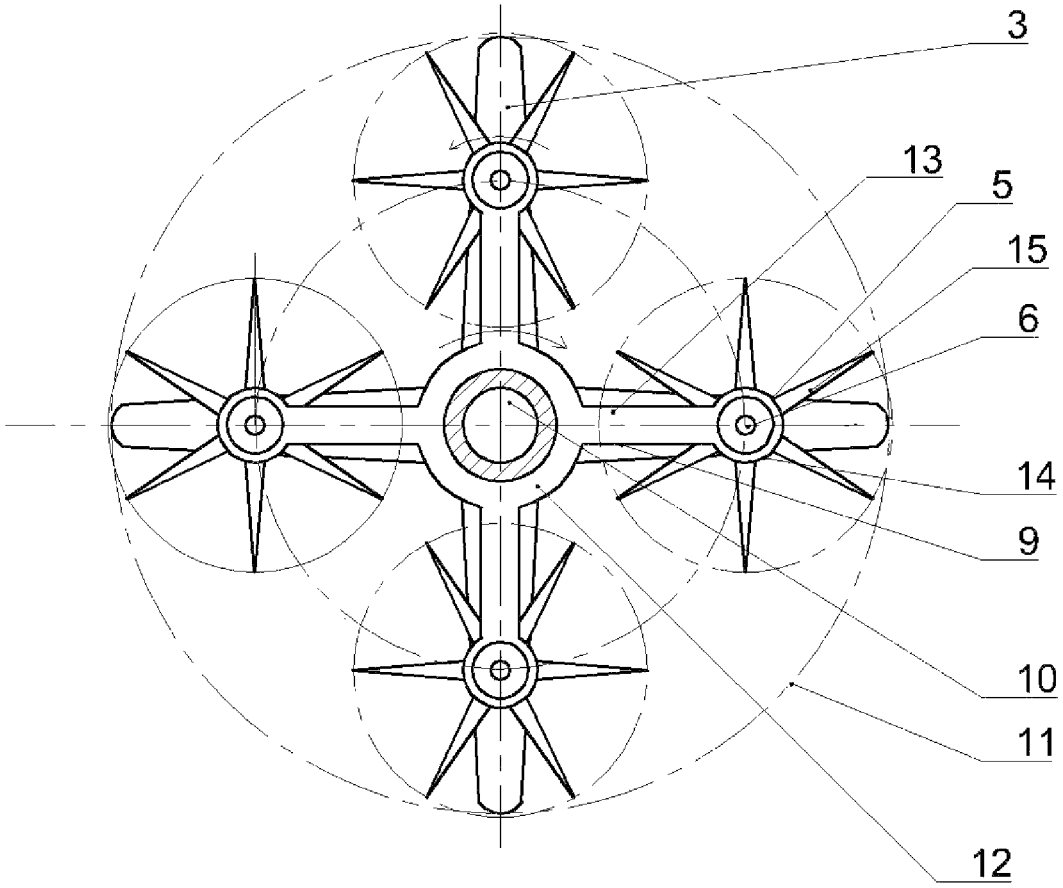
FIG. 2 is a top view of the present invention.

As shown in FIGS. 1 and 2, a first sealed end cover 71 is installed at a lower surface of each of the four peripheral disks 14, a second sealed end cover 72 is installed at an upper surface of each of the four cutting edges 3, a first bearing 81 is installed between the first sealed end cover 71 and the each of the four peripheral disks 14, a second bearing 82 is installed between the second sealed end cover 72 and the each of the four cutting edges 3, the four peripheral disks 14 are connected with the four cutting edges 3 through the four impeller shafts 6 respectively, an upper end and a lower end of each of the impeller shafts 6 respectively penetrate through the first sealed end cover 71 and the second sealed end cover 72, and then are respectively connected with the each of the peripheral disks 14 and the each of the four cutting edges 3 through the first bearing 81 and the second bearing 82 each of the passive impellers 5, which is fixedly connected with a middle portion of the each of the impeller shafts 6, comprises six blades 15 centered on the each of the impeller shafts 6 and uniformly distributed along a circumferential direction of the each of the impeller shafts 6, wherein an angle between two adjacent blades 15 is 60°; the four peripheral disks 14 are opposite to the four cutting edges 3 respectively along an axial direction of the hollow main drill pipe 10.

As shown in FIG. 2, during the drilling process, a rotation direction of the four passive impellers 5 is opposite to a rotation direction of the four cutting edges 3, and a working range of an end of the blades 15 of the four passive impellers 5 slightly exceeds a maximum working range of the four cutting edges 3, so as to ensure that the four passive impellers 5 generate passive rotation.

Embodiment

The drill bit 1 firstly drills into the soil during the drilling process, and maintains stable operation along the axial direction thereof during the subsequent drilling process; after the drill bit 1 penetrates through the soil, the four cutting edges 3 continue cutting underwater mucky soft soil, the cutter teeth 2 which uniformly distributed along the outer side of the cutting direction of the four cutting edges 3 cooperate with the four cutting edges 3 to enhance the cutting effect on the mucky soft soil; the rotation bracket 9 moves and rotates synchronously with the drill bit 1 during the drilling process.

During the drilling process, the impeller shafts 6 rotate with the rotation bracket 9 around a central axis of the drill bit 1, so that the passive impellers 5 contact with a hole wall 11 of a borehole; under double effects of the rotation of the rotation bracket 9 and the static hole wall 11, a relative rotation opposite to the rotation direction of the four cutting edges 3 is produced for enhancing the stirring effect on the silt, so as to improve the mud discharge efficiency during the drilling process, thereby improving the drilling efficiency, and reducing the occurrence of blockage of the mud suction pipe and blockage or even breakage of the drill bit due to poor mud discharge during the drilling process. Through the negative pressure generated by the rapid rotation between the hollow main drill pipe 10 and the borehole, the mud is sucked from the mud suction port 4, and finally through the hollow mud discharge pipe which is directly connected with a ground mud discharge device, the mud, which is formed by mixing water and the silt produced during the drilling process of caisson of intermediate tower of the bridge, is quickly discharged.

The invention claimed is:

1. A multi-impeller passive-rotating-stirring-type rotary drilling rig for open caissons, the drilling rig comprising a hollow main drill pipe, a drill bit, four cutting edges, four impeller shafts, four passive impellers and a rotation bracket, wherein:

the rotation bracket comprises a central disk, four short beams and four peripheral disks, wherein the four short beams are uniformly distributed along a circumferential direction at an outer side of the central disk, one end of each of the four short beams is connected with one of the four peripheral disks;

the hollow main drill pipe passes through the central disk and is fixedly connected with the rotation bracket through the central disk;

a mud suction port, which penetrates through the hollow main drill pipe along a radial direction of the hollow main drill pipe, is provided at a bottom portion of the hollow main drill pipe;

the drill bit is coaxially fixed with the hollow main drill pipe at a bottom end thereof;

the four cutting edges are uniformly distributed along a circumferential direction of the drill bit;

multiple cutter teeth are uniformly distributed along an outer side of a cutting direction of each of the four cutting edges;

the four peripheral disks are opposite to the four cutting edges respectively along an axial direction of the hollow main drill pipe;

a first sealed end cover is installed at a lower surface of each of the four peripheral disks, a second sealed end cover is installed at an upper surface of each of the four cutting edges;

a first bearing is installed between the first sealed end cover and the each of the four peripheral disks, a second bearing is installed between the second sealed end cover and the each of the four cutting edges;

the four peripheral disks are connected with the four cutting edges through the four impeller shafts respectively;

an upper end and a lower end of each of the impeller shafts respectively penetrate through the first sealed end cover and the second sealed end cover, and then are respectively connected with the each of the peripheral disks and the each of the four cutting edges through the first bearing and the second bearing;

each of the passive impellers, which is fixedly connected with a middle portion of the each of the impeller shafts, comprises six blades centered on the each of the impeller shafts and uniformly distributed along a circumferential direction of the each of the impeller shafts.

2. The multi-impeller passive-rotating-stirring-type rotary drilling rig for the open caissons according to claim 1, wherein during a drilling process, the cutting edges and the rotation bracket are driven to move axially by the hollow main drill pipe while rotating around a central axis of the hollow main drill pipe, so as to drive the impeller shafts to rotate around the central axis of the hollow main drill pipe; the blades of the passive impellers contact with a hole wall during a rotation of the rotation bracket, the hole wall provides the passive impellers with a force opposite to a rotation direction of the rotation bracket, so that the passive impellers produce a relative rotation opposite to a rotation direction of the rotation bracket.

3. The multi-impeller passive-rotating-stirring-type rotary drilling rig for the open caissons according to claim 1, wherein the first sealed end cover and the second sealed end cover are configured to limit a radial displacement of the each of the impeller shafts and have a sealing effect.

4. The multi-impeller passive-rotating-stirring-type rotary drilling rig for the open caissons according to claim 1, wherein the hollow main drill pipe is a hollow drill pipe, which is used to discharge mud formed by mixing silt and water in a process of drilling.

5. The multi-impeller passive-rotating-stirring-type rotary drilling rig for the open caissons according to claim 4, wherein the mud suction port is elliptical; the mud suction port and the passive impellers are located at a same horizontal height.

6. The multi-impeller passive-rotating-stirring-type rotary drilling rig for the open caissons according to claim 1, wherein during a rotation of the passive impellers, a working range of an end of the blades of the passive impellers exceeds a maximum working range of the cutting edges.

* * * * *